US006116482A

United States Patent [19]

Heiber

[11] Patent Number: 6,116,482

[45] Date of Patent: Sep. 12, 2000

[54] NARROW WIDTH GARMENT HANGER HAVING AN ERGONOMIC CLAMPING MECHANISM

[76] Inventor: Arnold Heiber, P.O. Box 8731, Horseshoe Bay, Tex. 78657-8731

[21] Appl. No.: 09/313,965

[22] Filed: May 18, 1999

[51] Int. Cl.[7] ..... A47G 25/48

[52] U.S. Cl. ..... 223/96; 223/91

[58] Field of Search ..... 223/96, 95, 93, 223/91, 90; 24/536

[56] References Cited

U.S. PATENT DOCUMENTS

| | | | |
|---|---|---|---|
| 567,537 | 9/1896 | Ernst | 24/536 |
| 995,298 | 6/1911 | Sims | 24/536 |
| 2,869,210 | 1/1959 | Schneider | 24/536 |
| 3,950,829 | 4/1976 | Cohen | 223/96 |
| 4,157,782 | 6/1979 | Mainetti | 223/96 |
| 4,231,500 | 11/1980 | Mainetti | 223/96 |

*Primary Examiner*—Bibhu Mohanty
*Attorney, Agent, or Firm*—Burr & Brown

[57] ABSTRACT

A garment hanger is provided that includes a support member, and at least one clamp attached to an end region of the support member. Each clamp includes a clamp body and an actuator. Each clamp body comprises opposed sidewalls hinged together at the upper portions thereof. These opposed sidewalls straddle the support member. Each clamp also includes a cutout formed through the sidewalls at least in the upper portions thereof. The clamps have two ramped surfaces on the inside of the clamp to minimize the width of the clamping mechanism and thus, the width of the hanger. By virtue of these ramped surfaces, the narrow clamp can be opened to accept garments having a wide range of thicknesses. As the clamp is opened, the ramp angle is reduced, providing increased mechanical advantage to counter an increased spring force, thus providing greater ease of operation. The thumb operated push-button actuator is used to open the clamps. This actuator is moveable within the cutout region to engage the ramp members. The clamp and actuator are slidable along the length of the support member, thereby allowing the position of the clamp and actuator to be adjusted along the support member, once the spacing between respective clamps to be adjusted. Preferably, the actuator comprises an upper pushbutton portion, a rounded lower head portion, and a pair of linear walls connecting the upper portion and rounded lower head portion. According to a second embodiment of the present invention, the support member includes a top section, a middle section, and a bottom section and the top section includes at least one detent therein. The actuator according to this second embodiment includes an indexing finger located on at least a portion of an interior wall of the actuator. Movement of the actuator causes the indexing finger to pass through the detent. This detent locks the clamp in place to prevent the clamp from moving laterally along the support member. Preferably, the top section of the support member may include an array of detents, which allow the clamp(s) to be locked in a variety of positions along the length of the support member.

17 Claims, 6 Drawing Sheets

NARROW WIDTH GARMENT HANGER HAVING AN ERGONOMIC CLAMPING MECHANISM

FIELD OF THE INVENTION

This invention relates generally to garment hangers, and specifically to garment hangers having narrow width clamping mechanisms and ergonomically efficient actuation of the clamping mechanism.

BACKGROUND OF THE INVENTION

Garment hangers for hanging slacks, trousers or skirts are well-known, and have been in use for quite some time. Commercial customers typically prefer hangers that display garments at full length. Such hangers must be efficient, easy to use, and capable of holding garments having a wide range of sizes, weights and thicknesses. Many prior art hangers use clamping mechanisms that require pinching action to actuate the opening of the clamping mechanism. However, actuation of such clamping mechanisms has proven to be ergonomically difficult and tiring when hanging more than one garment. Moreover, it is particularly valuable to minimize the average width occupied per garment in order to display the maximum number of garments for a given floor space. However, prior art garment hangers are disadvantageous since the clamping mechanisms themselves have considerable width. Clamping mechanisms of some prior art garment hangers are also disadvantageous in that the clamping mechanisms themselves are fixed along the length of the main hanger body and thus non-adjustable. This places significant limitations on the types and sizes of garments which may be used with certain hangers.

SUMMARY OF THE INVENTION

It is an object of the present invention to overcome the above-discussed drawbacks associated with known garment hangers.

Another object of the present invention is to provide a hanger that is easier and more efficient to operate than hangers of the prior art; that is easy and inexpensive to produce; and that maximizes the number of garments that can be hung in a given longitudinal space (by reducing the width of the hanger).

Each linear foot of hanger rack in retail stores occupies two square feet of floor space for the garments plus at least an additional four square feet of related aisle and end-aisle space. Thus, increasing the amount of garment inventory that can be displayed within each linear foot of clothing rack is equivalent to a low-cost store expansion. One means of increasing the garment density per linear foot of clothing rack is by the use of improved garment hangers. As the density of garment selections increases, a given amount of floor space is utilized much more efficiently since an increased number of garments can be displayed within the same volume or space. In turn, the profitability of the store in inventory turnover, the ratio of relative to fixed costs, and probability of customer product selection all experience significant increases.

The hanger of the present invention accomplishes these objectives through the use of an efficient thumb operated push-button actuator to open the clamps. The hanger also utilizes a clamping mechanism having at least one ramped surface on the inside of the clamp to minimize the width of the clamping mechanism, and thus the width of the hanger. By virtue of the ramped surfaces, the narrow clamp can be opened to accept garments having a wide range of thicknesses. As the clamp is opened, the ramp angle is reduced, providing increased mechanical advantage to counter an increased spring force, thus providing greater ease of operation. This combination of increasing mechanical advantage as the clamp is opened along with superior ergonomics allows for greatest ease of operation. To carry out the objects described above, one embodiment of the present invention is directed to a garment hanger which includes a support member, a clamp, and an actuator. Preferably, the support member includes a suspending member such as a hook.

At least one clamp is attached to an end region of the support member. If more than one clamp is used the clamps should preferably be attached to opposite end regions of the support member. In typical practice a pair of clamps is used to hold the garment. Each clamp body comprises opposed sidewalls hinged together at the upper portions thereof. These opposed sidewalls straddle the support member. Each clamp also includes a cutout formed through the sidewalls at least in the upper portions thereof. Complementary ramp members extend inwardly from inner opposed surfaces of the sidewalls. The hanger also includes an actuator for operating the clamp. The actuator is moveable to act between and engage the ramp members. In a preferred embodiment, the actuator is movable within a cutout region provided in the clamp body to engage the ramp members. As a result of actuator movement, the sidewalls of the clamp are forced apart, opening the clamp.

The clamp and actuator are slidable along the length of the support member. This feature advantageously allows the position of the clamp and actuator to be adjusted along the support member, thereby allowing the spacing between respective clamps to be adjusted. The actuator also serves to hold the clamp in place on the support member. In a preferred embodiment, the ramp members of one sidewall interleave with ramp members of the opposing sidewalls when the clamp is in either a closed or partially open position. This interleaving of the ramp members minimizes the width of the clamp, and hence, the garment hanger to thereby allow for more garments to be displayed in a given amount of space.

Preferably, the actuator comprises an upper pushbutton portion, a curved lower head portion, and a pair of linear walls connecting the upper portion and rounded lower head portion.

The clamp may operate in both a normal mode and an automatic mode. Each mode will now be described in detail.

In a normal mode of operation, the actuator is not pushed down all the way, and the ramp members are only in contact with the curved lower head portion of the actuator. That is, only the curved lower head will engage the ramped members, and the opposing sidewalls remain spaced apart so long as pressure is being applied to the actuator. In other words, when the clamp is operating in normal mode, the clamp will remain open as long as pressure is being applied to the pushbutton portion of the actuator. Similarly, the sidewalls will begin to close as the pressure on the actuator is decreased, and once this pressure is completely removed, the sidewalls will return to a closed position.

An additional feature of this hanger is that the hanger may have an automatic mode of operation in contrast to the normal mode of operation discussed above.

According to a key feature of the automatic mode of operation, the actuator is pressed downward sufficiently to cause the ramp members to engage the linear walls of the actuator. As a result, the clamp will automatically lock open such that the sidewalls will remain permanently spaced apart in a locked open condition. Once the sidewalls of the clamp are placed in this locked open condition, the sidewalls and the clamp can be automatically closed by a slight upward movement of the actuator caused, for example, by contact of the curved lower head portion with a garment inserted into the clamp.

In a preferred embodiment, the upper linear walls of the actuator are slightly tapered towards the center of the support member to cause an increase friction between the actuator and the support member when the actuator is depressed. The increased friction holds the actuator and, thus, the clamp body in place along the support member.

In a preferred embodiment at least one spring member engages the sidewalls to bias the sidewalls toward one another. Preferably the outer surface of each sidewall includes at least one pair of raised ridges for accommodating the spring member therebetween. The raised ridges retain the spring in position. Alternately, the sidewalls could also be biased by manufacturing the clamping mechanism with an inverted U-shape such that it has a built-in spring effect. This could be accomplished, for example, by injection molding the clamp using a reinforced plastic material or making it from a metal stamping.

The preferred embodiment also includes at least one retaining cap located on each end of the support member. This retaining cap prevents the clamp and actuator from sliding off the end of the support member.

According to a second embodiment of the present invention, a similar garment hanger is provided which also includes a support member, a clamp and an actuator. However, in this embodiment, the support member includes a top section, a middle section, and a bottom section, and the top section includes at least one detent therein. In a preferred embodiment, the cross-sectional width of the middle section is substantially less than cross-sectional width of the top or bottom section.

Clamps are preferably attached to opposite end regions of the support member. Each clamp includes opposed sidewalls hinged together at the upper portions thereof. These sidewalls straddle the support member. Each clamp also has a cutout formed through the sidewalls in at least the upper portions thereof. The ramp members should preferably extend inwardly from inner opposed surfaces of the sidewalls. An actuator is supported by each clamp, and is moveable within the cutout region to engage the ramp members. Actuator engagement with the ramp members forces the sidewalls apart from one another.

The actuator according to the second embodiment includes an indexing finger located on at least a portion of an interior wall of the actuator. Movement of the actuator causes the indexing finger to engage a detent. The indexing finger and detents cooperate to lock the clamp in place thereby preventing the clamp from moving laterally along the support member. Preferably, the top section of the support member may include an array of detents, which allow the clamp(s) to be locked in a variety of positions along the length of the support member.

The garment hanger according to the present invention is assembled by placing the actuator on the support member. The support member may optionally include a suspending member. The clamp is then assembled around the actuator such that the upper pushbutton portion of the actuator passes through the cutout region of the clamp and the sidewalls of the clamp straddle the support member. Preferably, spring members are then placed over the sidewalls to bias the sidewalls together. Clearly, the assembly of these garment hangers is simple, fast, and efficient.

Additional objects, advantages, and other novel features of the invention will become apparent to those skilled in the art upon examination of the detailed description and drawings that follow.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
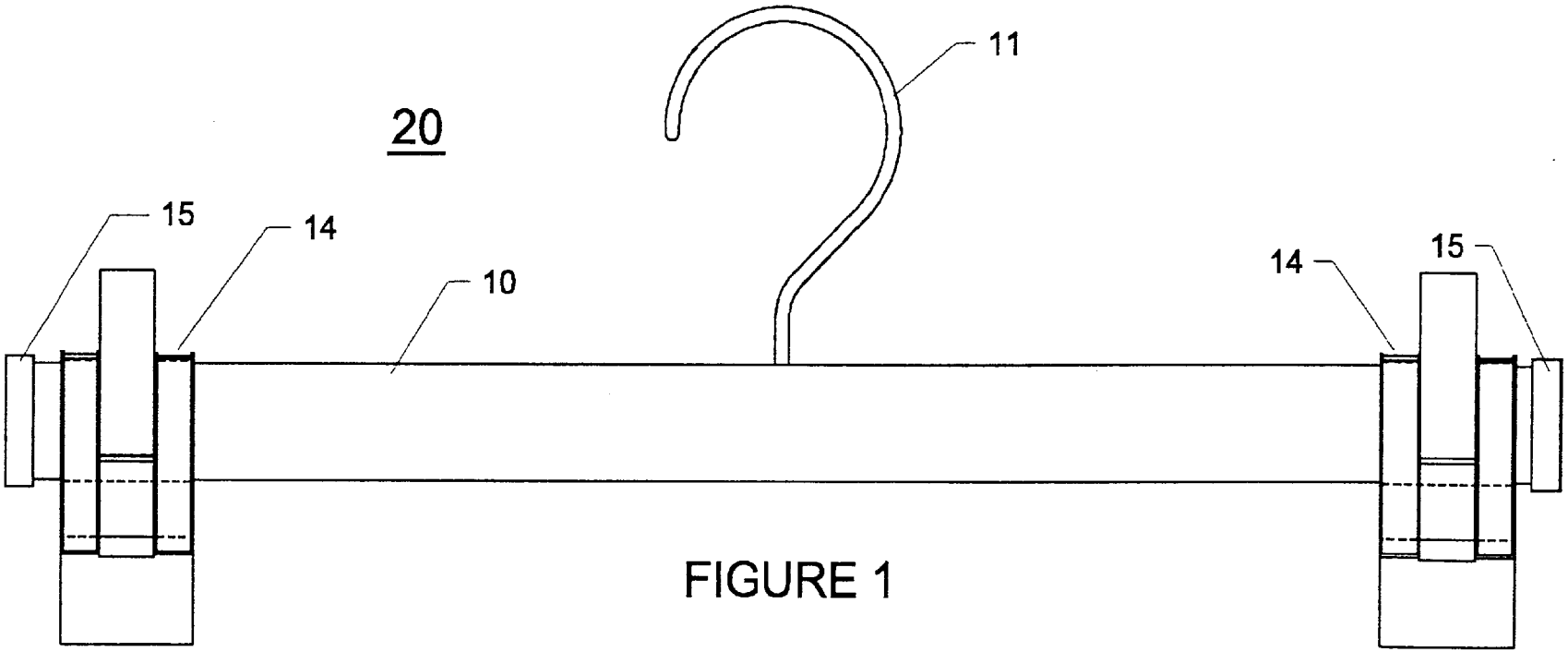
FIG. 1 shows a plan view of the assembled garment hanger having suspending means 11, a supporting member 10, two clamp assemblies 14, and two retaining caps 15.

In order that the present invention may be more readily understood, the following description is given, merely by way of example, reference being made to the accompanying drawings.

To carry out the objects described above, FIG. 1 shows one embodiment of the present invention directed to a garment hanger 20 which includes a support member 10, a clamp 14, and an actuator 1. The preferred embodiment of the hanger should include a suspending means 11, such as a hook, two clamps and two retaining caps 15 to prevent clamps 14 from sliding off the ends of support member 10. FIG. 2 shows a front view of the assembled clamp, while FIG. 5 shows the unfolded clamp body 2 as it would be molded if made of plastic.

Figures 2, 3, 4, 5, 6, 7:
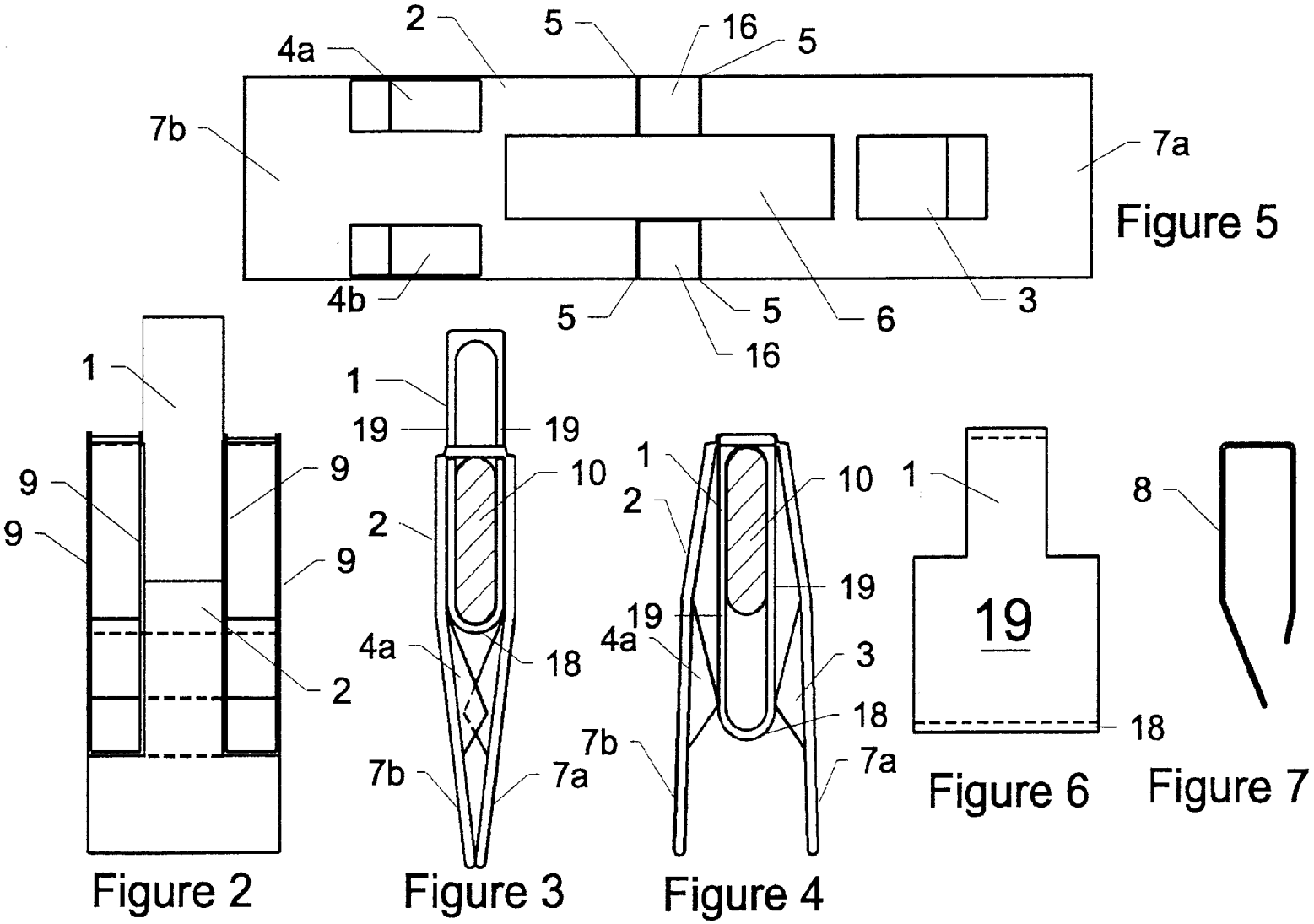
FIG. 2 shows a front view of the assembled clamp.
FIG. 3 shows a side view of the assembled clamp with a section of the support member.
FIG. 4 shows the side view as shown in FIG. 3, but with the actuator at maximum depth and the clamp opened to maximum width.
FIG. 5 shows the unfolded clamp body 2 as it could be molded if made of plastic.
FIG. 6 shows the push-button actuator 1.
FIG. 7 shows a spring member 8 which fits over the folded clamp body 2 to provide the clamping force and hold the assembly together.

As shown in FIG. 1, clamps 14 are attached to opposite end regions of support member 10. Each clamp 14 includes a clamp body 2 and an actuator 1. Each clamp body 2 includes a pair of opposed sidewalls 7*a*, 7*b* hinged together at the upper portions 5 thereof. The sidewalls 7*a*, 7*b* of each clamp body 2 straddle support member 10. Each clamp body 2 also includes a cutout 6 formed through sidewalls 7*a*, 7*b* at least in the upper portions 5 thereof. Ramp members 3, 4*a*, 4*b* extend inwardly from inner opposed surfaces of sidewalls 7*a*, 7*b*. Actuator 1 is supported by support member 10 and clamp body 2 and is moveable within cutout 6 to engage ramp members 3, 4*a*, 4*b* and force sidewalls 7*a*, 7*b* apart from one another.

FIGS. 3, 4 and 6 illustrate that the pushbutton actuator 1 is tubular and sized to exhibit a frictional fit around support member 10. Additionally, clamp body 2 and actuator 1 are laterally slidable along and engage support member 10 thereby allowing the position of clamp 14 to be adjusted. Clamp body 2 is held in place on support member 10 by actuator 1. As illustrated by FIGS. 3 and 4, in a preferred embodiment, ramp member 3 of sidewall 7*a* interleaves with ramp members 4*a*, 4*b* of opposing sidewall 7*b* when the clamp 14 is in a closed position. That is, clamp 14 has sidewalls 7*a*, 7*b*, and each sidewall has a cutout region 6 therebetween for insertion of actuator 1 therethrough. The interior portion of sidewall 7*a* has a first ramp member 3 while the interior portion of sidewall 7*b* has complementary second ramp members 4*a*, 4*b* which interleave with the first ramp member 3 when the sidewalls 7 are in a closed position. The complementary second ramp members 4*a*, 4*b* are spaced apart to receive first ramp member 3 therein. The interleaved ramps 3, 4*a* and 4*b* are preferably molded into clamp body 2, and in addition to their role in clamp actuation, act to stiffen the clamp body sidewalls.

Actuator 1 surrounds support member 10 such that actuator 1 is laterally slidable along the length of support member 10. Actuator 1 comprises an upper pushbutton portion 17, a curved lower head section 18, and a pair of linear walls 19 connecting the upper portion 17 and the curved lower head portion 18. FIG. 4 shows a side view as shown in FIG. 3, but with the pushbutton actuator at the maximum depth and the clamp 14 opened to maximum width. The clamp assembly can be made as shown in FIG. 4, such that when actuator 1 is fully engaged, clamp 14 will remain open without requiring any effort to maintain its opened position. The linear walls 19 are of sufficient length to allow contact between the linear walls and the ramp members 3, 4*a*, 4*b* when a downward force is applied to the upper pushbutton portion thereby spacing the linear walls apart in a locked condition. If desired, sidewalls 7*a*, 7*b* can then be automatically closed by moving actuator 1 upward. Sidewalls 7*a*, 7*b* close when ramp members 3, 4*a*, and 4*b* are in contact with the curved lower head portion 18 and the downward force is removed. In a preferred embodiment, the inside of linear walls 19 of actuator 1 can be slightly tapered towards the center of the support member 10 to increase friction between the support member 10 and the actuator 1. This may be desirable when support member 10 is made of wood rather than molded from plastic.

FIG. 7 shows a spring member 8 which fits over the folded clamp body 2 to provide a clamping force that holds the clamp together. This spring member 8 engages sidewalls 7*a*, 7*b* to bias the sidewalls toward one another. Preferably, two springs 8 are used on each clamp body, although a single spring can be used. As shown in FIGS. 2 and 5, springs 8 fit between raised ridges 9 on clamp body 2. The raised ridges 9 retain the spring in position laterally, and stiffen the clamp body 2.

The preferred embodiment also includes at least one retaining cap 15 located on one end of support member 10 to prevent clamp 14 and actuator 1 from sliding off the end of support member 10. As an alternative to using springs 8, sidewalls 7 could also be biased by structuring the clamping mechanism with an inverted U-shape such that it has a built-in spring effect. This could be accomplished by injection molding the clamp using reinforced plastic or a similar material.

Figure 8:
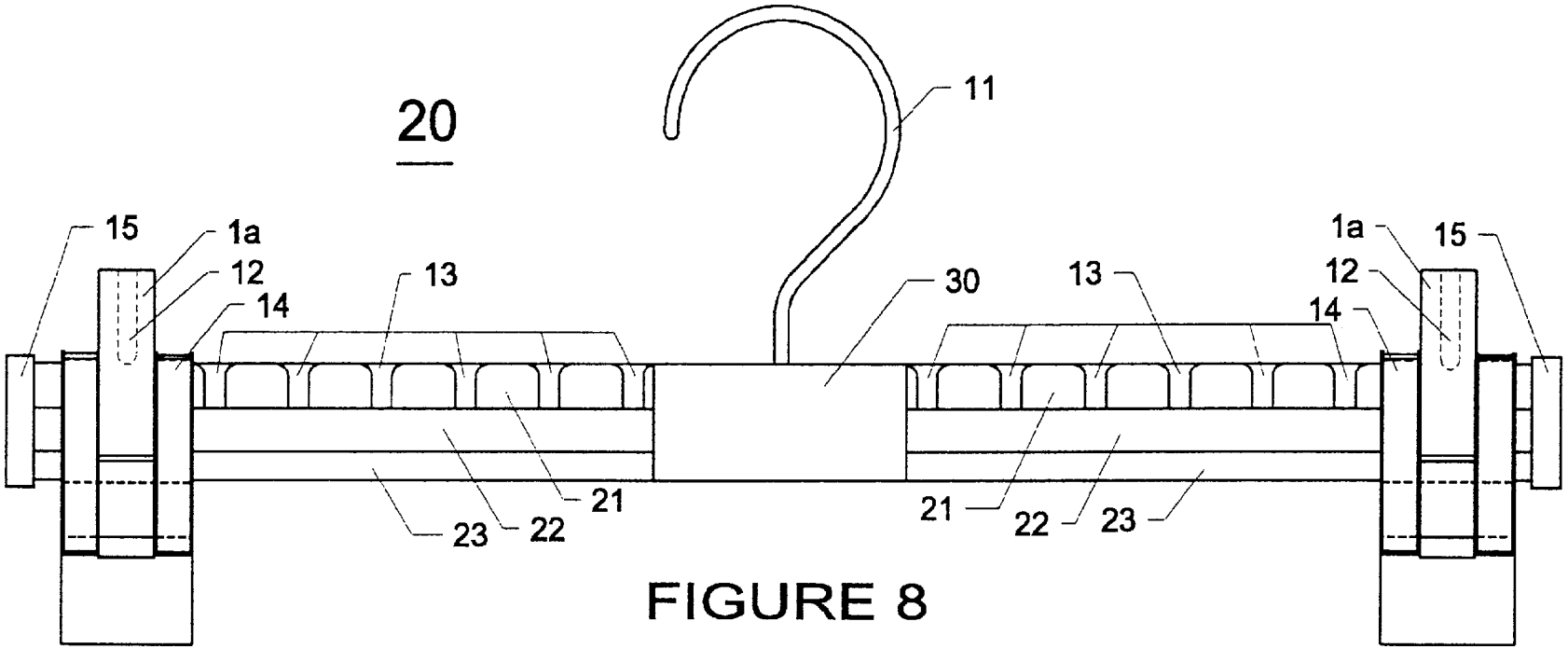
FIG. 8 shows an alternate embodiment of the garment hanger having an actuator 1*a* with indexing fingers 12 molded into the inner sides of actuator 1*a*, and a support member 10 in which detents 13 are arrayed to accept indexing finger 12 upon actuation of the clamp 14.
Figure 11:
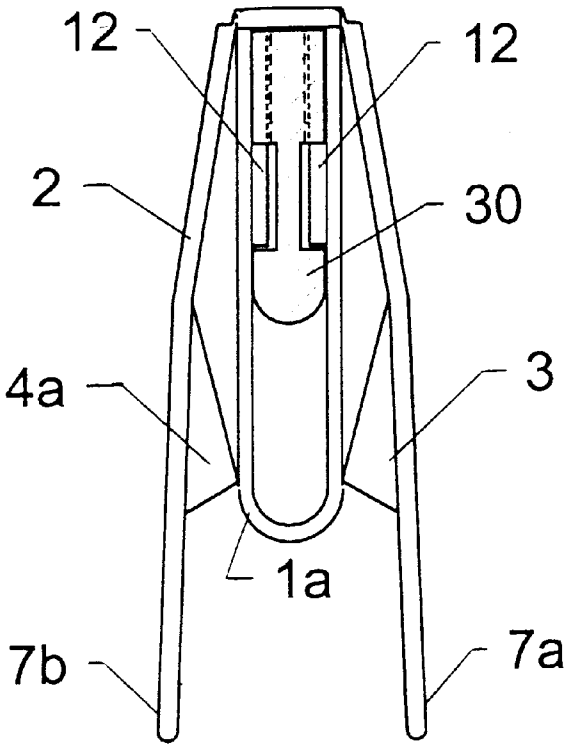
FIG. 11 shows the side view as shown in FIG. 10, but with the pushbutton actuator 12 at maximum depth and the clamp 14 opened to maximum width.
Figure 10:
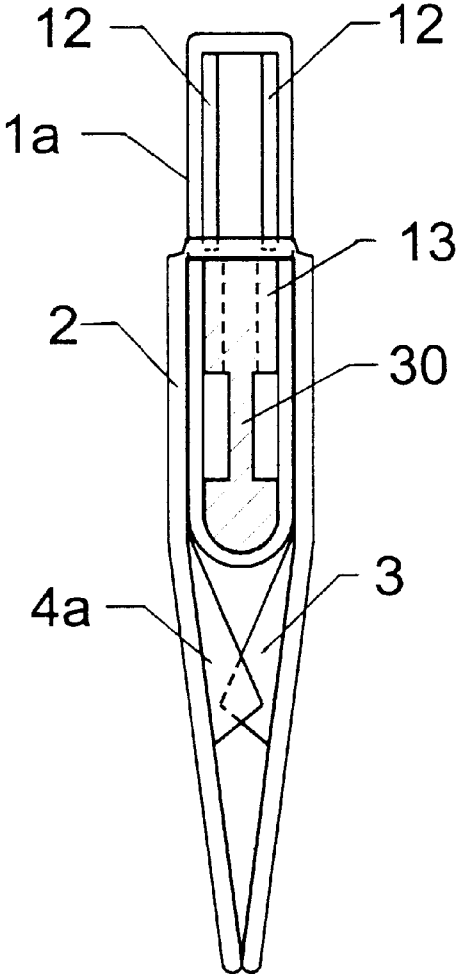
FIG. 10 shows a side view of the clamp 14 of FIG. 8 with a section of the support member 10.

FIG. 8 shows a second embodiment of the present invention in which a garment hanger 20 is provided which includes a support member 30, a clamp 14, and an actuator 1*a*. The support member 30 includes a top section 21, a middle section 22, and a bottom section 23. The top section 21 includes at least one detent 13 therein. Clamps 14 are attached to opposite end regions of the support member 30. The clamp 14 includes opposed sidewalls 7*a*, 7*b* hinged together at the upper portions 5 thereof. Sidewalls 7*a*, 7*b* straddle the support member 30. Each clamp 14 has a cutout 6 formed through the sidewalls at least in the upper portions 5 thereof (FIGS. 10–11). Ramp members 3, 4*a*(4*b*, not shown) extend inwardly from inner opposed surfaces of the sidewalls.

Figure 9:
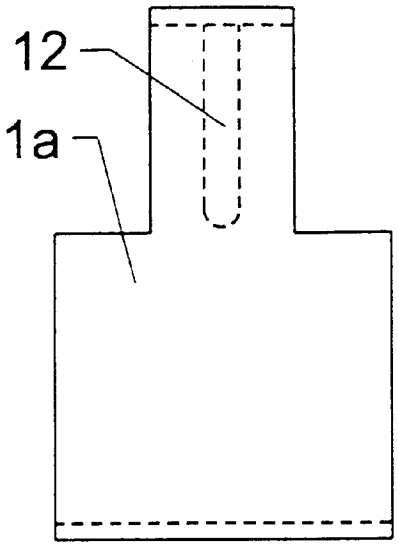
FIG. 9 shows a front view of the actuator 1*a* having an indexing finger 12 on an inner wall thereof.

Each clamp 14 includes an actuator 1*a*, which is moveable within the cutout 6 region to engage the ramp members and force the sidewalls 7 apart from one another. According to the second embodiment, FIGS. 9, 10 and 11 show a variation of the actuator 1*a* in which indexing fingers 12 are molded into at least a portion of an interior wall thereof. Up and down movement of the actuator 1*a* allows the indexing finger 12 to engage one of the detents 13. In this variation, operating actuator 1*a* not only operates the clamp, but also locks the clamp 14 in position along the support member 30. This prevents clamp 14 from moving laterally along support member 30.

In a preferred embodiment, the cross-sectional width of the middle section 22 is substantially less than the cross-sectional width of top section 21 or bottom section 23. Moreover, top section 21 of support member 30 may include an array of detents 13.

The garment hanger 20 according to the present invention is assembled by placing either of the above described actuators 1, 1*a* on either of the support members 20,30, respectively. A clamp body 2 is then folded around each of actuators 1, 1*a* so that the upper part of the actuator, which acts as a push-button, extends through the cutout 6 in the sidewalls 7 and top 5 of clamp body 2. Thus, the upper pushbutton portion of the actuator 1 is inserted through the cutout region 6 so that clamp body 2 straddles the support member 10, 30. The spring members 8 are placed around clamp body 2. In the design shown, one end of the springs will nest into the outer indentation and the other end will wrap around the other side where it changes angles toward the clamping surfaces of the sides 7.

The clamps 14 are operated by wrapping the fingers around the lower part of the support member 10, 30 and placing the thumb on top of the actuator 1, 1*a*. Pressing down with the thumb on the top of the actuator causes the lower end thereof to be wedged between the interleaved inclined ramps 3, 4*a* and 4*b*. As a result, the sidewalls 7 of the clamp are spread apart. If the thumb pressure is released before the actuator 1, 1*a* reaches the point where the ramps rest on the linear walls 19 of the actuator, the clamp 14 will close as the thumb is raised. In an alternative automatic operation, if the actuator 1, 1*a* is pushed to the limit with the ramps resting on the linear walls 19 of actuator 1, 1*a*, the clamp 14 will remain open without any pressure required to hold it open. The clamp 14 can be released either by pulling up on the actuator 1, 1*a* or by placing a garment into clamp 14 and pressing it up against the curved lower head portion 18 of actuator 1, 1*a*, which will cause clamp 14 to automatically snap shut on the inserted garment.

Figure 13:
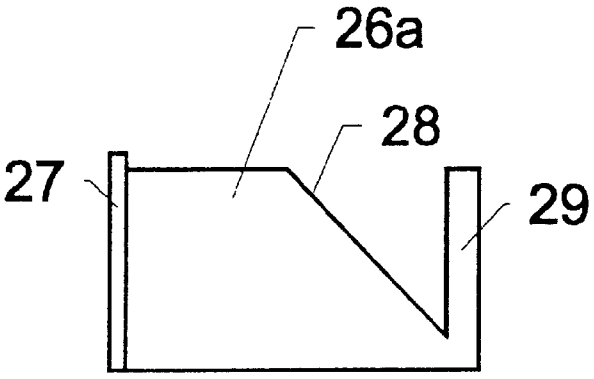
FIG. 13 shows a side view of the actuator element 26*a* shown in FIG. 12.
Figure 14:
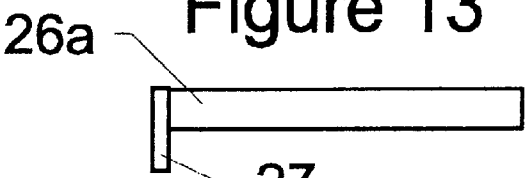
FIG. 14 shows a bottom view of one of the actuator elements 26*a*, shown in FIG. 12, illustrating an offset which allows the actuator elements 26*a*, 26*b* to slide by each other when pinched together.
Figure 12:
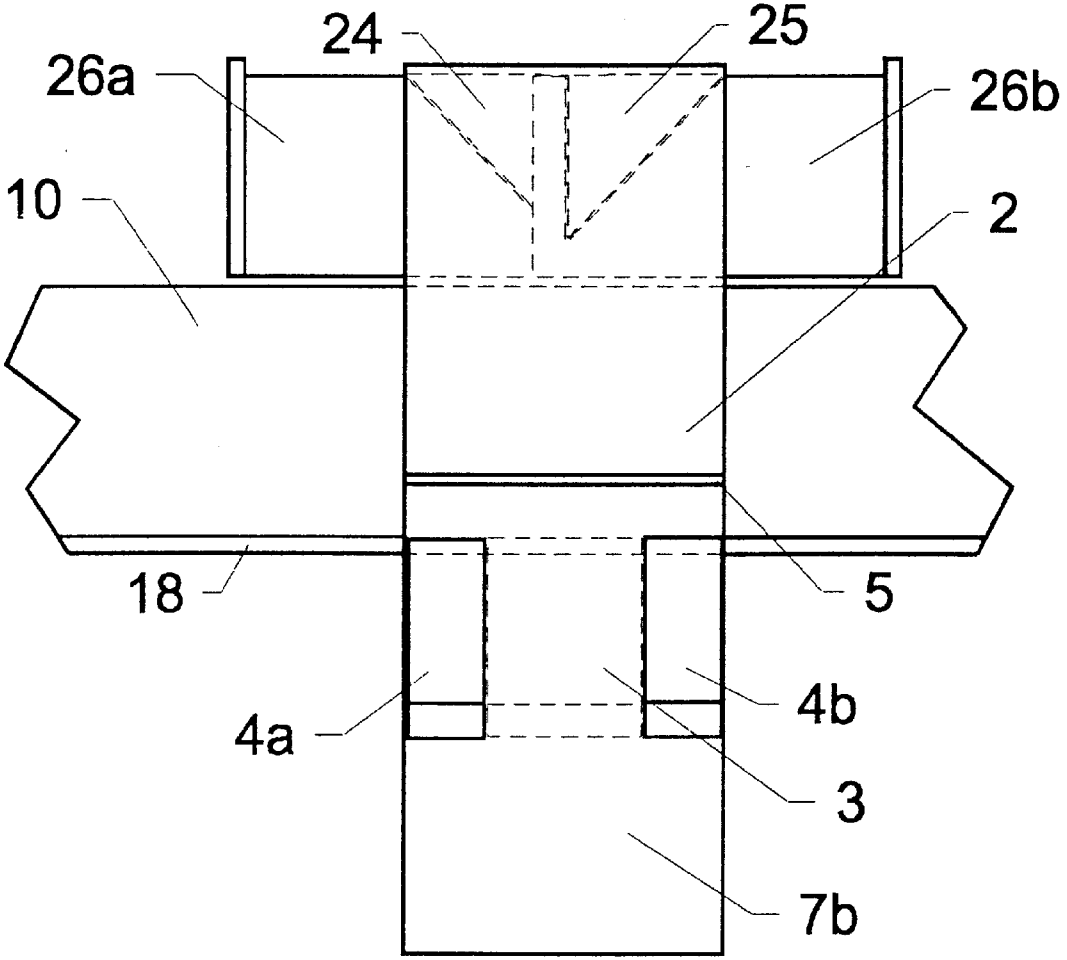
FIG. 12 shows an alternative embodiment of the garment hanger according to the present invention having a pair of actuator elements acting parallel to the support member.

According to an alternative embodiment, as shown in FIGS. 12–14, a garment hanger is provided which includes a support member 10, a clamping body 2, and an actuator 26*a*, 26*b*. In this embodiment, the clamp body moves upward, while the support member functions as part of the actuating mechanism. As shown in FIG. 12, clamping body 2 straddle a section of support member 10. The clamping body again includes opposed sidewalls connected at respective upper portions thereof. An inner surface of each sidewall includes inwardly extending ramp members 3, 4*a*, and 4*b*. Preferably, the bottom edge 18 of support member 10 is curved to act as part of the actuating mechanism as it engages ramp members 3, 4*a* and 4*b*. Pushing inward on actuator elements 26*a*, 26*b* causes the clamp body to move upward thereby opening the clamp. As shown in FIG. 12, the actuator comprises a pair of opposing actuator elements 26*a*, 26*b* which are oppositely orientated. The actuator elements are laterally moveable between the sidewalls. The pair of opposing actuator elements 26*a*, 26*b* are slightly offset, to permit the actuator elements to slide by each other when they are pinched inwardly together. As the elements are pinched inwardly together, an inclined cutout portion 28 formed in each actuator element engages a respective wedge shaped element 24, 25 located on each of the inner sidewalls of clamp body 2 near the upper portion thereof. This pinching of the elements together causes the clamp body to move upward. A pressure pad 27 allows pressure to be applied to each of the actuator elements, thereby causing the inclined surface 28 to bear on wedge shaped elements 24 or 25. A retaining member 29 contacts a back end of elements 24, 25 to keep the actuator elements within the clamp body.

Figure 16:
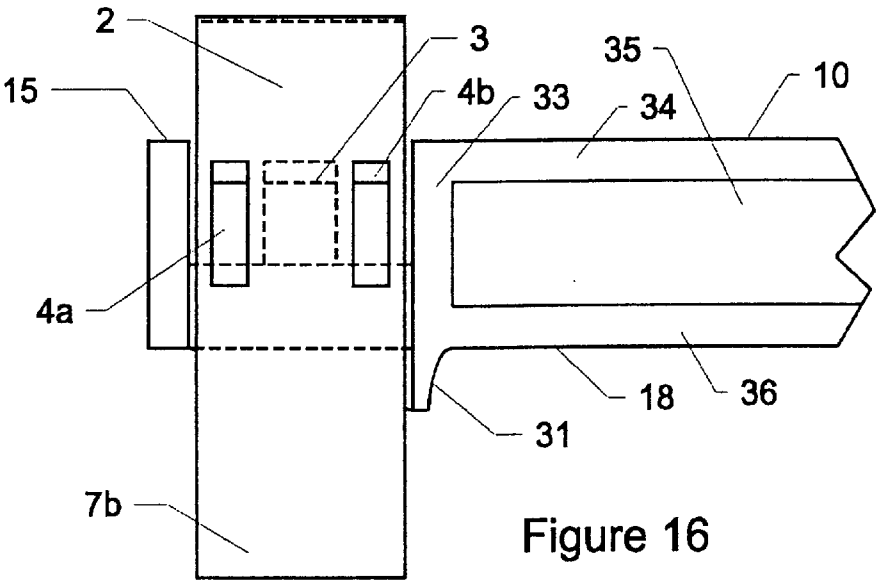
FIG. 16 shows the section of the support member shown in FIG. 15 in which downward actuation of the clamp body 2 will engage the ramp members 3, 4*a*, and 4*b* with the curved section 32 of said support member to operate the clamp.
Figure 15:
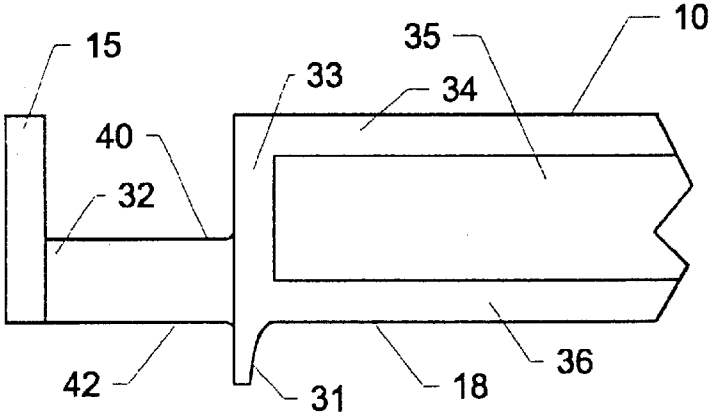
FIG. 15, shows an alternative embodiment according to the present invention illustrating a portion of a support member which has a section with curved edges 32.

As shown in FIGS. 15 and 16, another alternative embodiment of the hanger eliminates the actuator entirely. FIG. 15 shows a segment of the support member 10, which has a section 32 having a curved upper surface that engages the ramp members of the clamp body. The curved edge 40 facilitates engagement with the inwardly extending ramp members 3, 4*a* and 4*b*. These inwardly extending ramp members engage the support member upon movement of the clamping body to thereby cause the sidewalls of the clamp body 2 to move apart from each other. A lower section 34 of the beam shaped support member may optionally include a finger guard 31 to keep a person's hand away from the moveable clamp 2. The finger guard is at the lower portion of a guide member 33 on one side of the clamp. An end cap 15 may also be optionally included to retain the clamp on a portion of the support member 32.

According to this embodiment, the person's fingers wrap around the lower edge of the support member near the finger guard 31, and the person's thumb applies pressure to the top of the clamp body 2 thereby causing the channeled section 32 of the support member within the clamp body 2 to engage the ramp members 3, 4*a*, 4*b* and force the sidewalls 7*b* of the clamp 2 apart. FIG. 16, shows the end section of the support member with clamp body 2 in place. The clamp body is designed so that the lower tips of the sidewalls nearly touch when in the closed position. This insures that the clamp body is held in place on the support member. The clamp body 2 could be constructed of many materials, for example, a spring metal stamping. This embodiment is much simpler to assemble and therefore a less costly version of the hanger. Alternatively, the clamp body could be made of non-spring material and incorporate retaining springs, as in the earlier embodiments.

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. A garment hanger, comprising:

a support member;

a clamping body attached to opposite end regions of said support member, said clamping body comprising opposed sidewalls connected at upper portions thereof, wherein an inner surface of at least one sidewall below said upper portion includes at least one inwardly extending member; and an actuator moveable between said sidewalls to engage said at least one inwardly extending member and force said sidewalls apart from one another.

2. A garment hanger, comprising:

a support member;

a clamping body attached to opposite end regions of said support member, said clamping body comprising opposed sidewalls connected at upper portions thereof, wherein an inner surface of at least one sidewall includes at least one inwardly extending member;

an actuator moveable between said sidewalls to engage said at least one inwardly extending member and force said sidewalls apart from one another; and at least one spring member engaging said sidewalls to bias said sidewalls toward one another.

3. The garment hanger as recited in claim 2, wherein an outer surface of each sidewall further comprises at least one pair of raised ridges for accommodating said at least one spring member therebetween, and wherein said raised ridges retain said spring member in position.

4. The garment hanger as recited in claim 1, further comprising at least one retaining cap located on one end of said support member to prevent said clamping body and actuator from sliding off the end of said support member.

5. The garment hanger as recited in claim 1, wherein said clamping body and actuator are laterally slidable along and engaging said support member thereby allowing the position of the clamping body and actuator to be adjusted.

6. The garment hanger as recited in claim 1, wherein said clamping body is held in place on said support member by said actuator.

7. A garment hanger, comprising:

a support member;

a clamping body attached to opposite end regions of said support member, said clamping body comprising opposed sidewalls connected at upper portions thereof, wherein an inner surface of at least one sidewall includes at least one inwardly extending member; and an actuator moveable between said sidewalls to engage said at least one inwardly extending member and force said sidewalls apart from one another;

wherein said clamping body has at least a first sidewall and a second sidewall, said sidewalls having a cutout region therebetween for insertion of said actuator therethrough, an interior portion of said first sidewall having a first ramp member and an interior portion of said second sidewall having complementary second ramp members which interleave with said first ramp member when said sidewalls are in a closed position.

8. The garment hanger as recited in claim 7, wherein said ramp members of one sidewall interleave with ramp members of the opposing sidewall when said clamping body is in both a closed and partially opened position.

9. The garment hanger as recited in claim 8, wherein said complementary second ramp members are spaced apart.

10. The garment hanger as recited in claim 1, wherein the upper sidewalls of said actuator are slightly tapered towards the center of the support member to increase the friction between said actuator and said support member when said actuator is operated.

11. The garment hanger as recited in claim 1, wherein said support member includes a suspending member.

12. The garment hanger as recited in claim 11, wherein said suspending member comprises a hook.

13. The garment hanger as recited in claim 7, wherein said actuator surrounds said support member such that said actuator is longitudinally slidable along a length of said support member.

14. The garment hanger as recited in claim 13, wherein said actuator comprises an upper pushbutton portion, a curved lower head portion, and a pair of linear walls connecting said upper portion to said curved lower head portion.

15. The garment hanger as recited in claim 14, wherein said linear walls are of sufficient length to allow contact between said linear walls and said ramp members, at a position of the actuator stroke, thereby spacing said ramp members apart in a locked condition.

16. The garment hanger as recited in claim 14, wherein said sidewalls are automatically closed by moving the actuator away from said clamping body.

17. The garment hanger as recited in claim 13, wherein said sidewalls close when said ramp members are in contact with said curved lower head portion and a downward force is removed.

* * * * *